US010385811B2

(12) United States Patent
Newman et al.

(10) Patent No.: US 10,385,811 B2
(45) Date of Patent: Aug. 20, 2019

(54) AIR INTAKE MANIFOLD

(71) Applicant: MSD LLC, Bowling Green, KY (US)

(72) Inventors: Caleb Newman, Troy, MI (US); Otis Ferguson, El Paso, TX (US); Russell Stephens, El Paso, TX (US); Jeffrey Sperry, Troy, MI (US)

(73) Assignee: MSD LLC, Bowling Green, KY (US)

( * ) Notice: Subject to any disclaimer, the term of this patent is extended or adjusted under 35 U.S.C. 154(b) by 47 days.

(21) Appl. No.: 15/522,682

(22) PCT Filed: Oct. 31, 2015

(86) PCT No.: PCT/US2015/058530
§ 371 (c)(1),
(2) Date: Apr. 27, 2017

(87) PCT Pub. No.: WO2016/070165
PCT Pub. Date: May 6, 2016

(65) Prior Publication Data

US 2017/0335809 A1 Nov. 23, 2017

Related U.S. Application Data

(60) Provisional application No. 62/073,894, filed on Oct. 31, 2014.

(51) Int. Cl.
*F02M 35/10* (2006.01)
*F02M 35/116* (2006.01)

(52) U.S. Cl.
CPC ..... *F02M 35/10354* (2013.01); *F02M 35/10026* (2013.01); *F02M 35/10091* (2013.01); *F02M 35/116* (2013.01)

(58) Field of Classification Search
CPC ..... F02M 35/10354; F02M 35/10026; F02M 35/116; F02M 35/10091; F02M 35/104
See application file for complete search history.

(56) References Cited

U.S. PATENT DOCUMENTS

| | | | |
|---|---|---|---|
| 4,240,384 | A | 12/1980 | Urbinati et al. |
| 4,681,178 | A | 7/1987 | Brown |
| 4,802,902 | A | 2/1989 | Bauerle et al. |
| 4,826,411 | A | 5/1989 | Gaeth |
| 4,929,260 | A | 5/1990 | Bauerle |

(Continued)

FOREIGN PATENT DOCUMENTS

WO 2016070165 5/2016

OTHER PUBLICATIONS

IP Australia, Australian Examination Report No. 1 for AU2015338922 dated Jul. 23, 2018.

(Continued)

*Primary Examiner* — Hung Q Nguyen
*Assistant Examiner* — Brian P Monahon
(74) *Attorney, Agent, or Firm* — Middleton Reutiling

(57) ABSTRACT

An air intake manifold for an internal combustion engine having a top shell and a base weldment. The base weldment is formed by permanent joining of a bottom shell having a plurality of air outlets with a runner assembly having a plurality of runner components each having an air inlet and an air outlet, wherein the plurality of runner components are attached to one another via a support member to form the runner assembly.

16 Claims, 13 Drawing Sheets

(56) References Cited

U.S. PATENT DOCUMENTS 5,357,931 A * 10/1994 Semence ..... F02D 41/3005 123/184.61
5,687,684 A * 11/1997 Verkleeren ..... F02B 27/02 123/184.55
5,718,205 A * 2/1998 Jo ..... F02D 9/1065 123/337
5,762,036 A * 6/1998 Verkleeren ..... F02B 27/02 123/184.31
5,950,587 A * 9/1999 Sattler ..... F02B 27/0257 123/184.53
6,053,148 A * 4/2000 Glovatsky ..... F02M 35/10072 123/184.34
6,092,498 A 7/2000 Lohr et al.
6,260,537 B1 * 7/2001 Lamb ..... F02M 35/10078 123/456
7,021,263 B1 * 4/2006 Agnew ..... F02M 35/10039 123/184.34
D574,852 S 8/2008 Grant
D654,094 S 2/2012 Dralle
8,955,485 B2 * 2/2015 Kulkarni ..... F02M 35/1045 123/184.47
9,861,922 B1 1/2018 Townsend
2003/0079707 A1 * 5/2003 Brassell ..... F02M 35/10045 123/184.61
2003/0101957 A1 * 6/2003 Benson ..... F02B 75/22 123/184.34
2004/0261770 A1 * 12/2004 Lee ..... F02M 35/10072 123/470
2005/0229891 A1 * 10/2005 Kokubo ..... F02M 35/10052 123/184.57
2005/0279310 A1 * 12/2005 Kondo ..... F02B 31/085 123/184.21
2005/0279328 A1 * 12/2005 Zdroik ..... F02M 35/10216 123/470
2006/0005820 A1 * 1/2006 Jeon ..... F02M 35/10039 123/572
2008/0210189 A1 9/2008 Boyes et al.
2010/0024406 A1 * 2/2010 Pollitt ..... F01N 3/2066 60/310
2010/0031913 A1 2/2010 Rolland et al.
2011/0005488 A1 * 1/2011 Reese ..... F02M 35/10039 123/184.61
2011/0168120 A1 * 7/2011 Bruman ..... F02B 27/00 123/184.35
2013/0125851 A1 * 5/2013 Miyashita ..... F02M 35/104 123/184.21
2013/0199486 A1 * 8/2013 Yano ..... F02M 35/104 123/184.21
2014/0096734 A1 * 4/2014 Dudek ..... F02M 35/10255 123/184.53
2017/0335809 A1 11/2017 Newman et al.

OTHER PUBLICATIONS

Design U.S. Appl. No. 29/597,917 entitled "Adapter" filed Mar. 21, 2017.
Design U.S. Appl. No. 29/583,805 entitled "Air Cleaner" filed Nov. 9, 2016.
Design U.S. Appl. No. 29/599,276 entitled "Air Intake Housing" filed Mar. 31, 2017.
Australian Patent Application No. 2015338922 entitled "Air Intake Manifold" entered national stage May 4, 2017.
U.S. Patent and Trademark Office, International Search Report and Written Opinion for PCT/US2015/058530 dated Dec. 22, 2015.
Transmittal Letter of Related Cases.
Design U.S. Appl. No. 29/599,278 entitled "Ornamental Component" filed Mar. 31, 2017.
IP Australia, Australian Examination Report No. 2 for AU2015338922 dated Jan. 23, 2019.

* cited by examiner

AIR INTAKE MANIFOLD

CROSS-REFERENCE TO RELATED APPLICATIONS

This Non-Provisional National Stage application claims priority to and benefit under 35 U.S.C. § 365(b) to PCT Application PCT/US2015/058530, filed Oct. 31, 2015, titled "Air Intake Manifold", which claims priority to and benefit under 35 U.S.C 119 to U.S. Provisional Application No. 62/073,894 filed 31 Oct. 2014, all of which is incorporated by reference herein.

TECHNICAL FIELD

Exemplary embodiments of the present invention relate generally to internal combustion engine components, and more specifically to air intake manifolds, particularly after-market replacement air intake manifolds.

BACKGROUND OF THE INVENTION

One component of internal combustion engines is typically the air intake manifold. The air intake manifold directs clean air from the exterior of the engine or vehicle and mixes the air with fuel, where it then flows into the cylinder heads for combustion. A variety of air intake manifolds are found in the prior art for various applications, and it is often a goal of such manifolds to reduce airflow restrictions and to allow for a greater volumetric efficiency. Many prior art manifold designs are costly to manufacture, and have no portability between engine types and configurations. Furthermore, in order to provide the functionality of an intake manifold while fitting within original equipment manufacturer (OEM) space limitations, the internal air passageways that direct the air from a common inlet to the multiple individual cylinder ports are curved, and once produced are difficult for an end user to further modify due to complexity and size.

Some air intake manifolds attempt to overcome these problems by providing modular manifold assemblies. These types of manifolds are typically made of many removable parts, and may include individually removable runners bolted to the manifold shell components. While such manifolds allow for easier disassembly and therefore interchangeability of internal parts, the manifolds themselves do not have the structural robustness found in traditional, integrated cast, molded or welded manifolds.

It is therefore an unmet need in the prior art for an air intake manifold having permanently attached air passageways that also provide ready access to end users in order to modify the airflow characteristics of the manifold to suit a particular application or desired airflow characteristics. No known references, taken alone or in combination, are seen as teaching or suggesting the presently claimed air intake manifold.

BRIEF SUMMARY OF THE INVENTION

Exemplary embodiments of the present disclosure pertain to air intake manifolds for use with internal combustion engines having upper and lower shells secured together to form a plenum chamber therebetween. The manifold includes an air inlet, and a plurality of air outlets positioned at one or more external mating faces, which may mate to cylinder ports on the engine via a gasket. In some embodiments, the air inlet is formed in the upper shell. Embodiments include a runner assembly formed of a plurality of connected runner components. The runner assembly is welded or otherwise fixed permanently to the lower shell at the air outlets.

In some embodiments, the runner components are connected to one another via a single, threaded support member joining together the support member apertures on each runner component to form the runner assembly and provide cantilever force support to the runner components of the runner assembly.

In some embodiments, the runner components are formed of injection molded runner halves that are subsequently vibration welded together to form a runner weldment. The runner weldments are then connected to each other via a support member to form a runner assembly. The runner assembly is then vibration welded to the lower shell to form a base weldment.

An object of some embodiments is to provide a plenum assembly seal that is positioned between the upper and lower shells before attaching them to one another. In some embodiments, the plenum assembly seal is further provided with a plurality of injector seals that are tethered to the plenum assembly seals at injector positions. The injector seals provide a seal at the upper shell to runner interface at the injector port such that tuning pulse strength is not diminished by internal leaks.

In one embodiment, the intake manifold includes a base weldment and an upper shell. The base weldment has a lower shell having a plurality of air outlets, and a runner assembly. The runner assembly has a plurality of runners each having an air inlet, an air outlet and a mating flange adjacent to the air outlet, a support member joining all of the runners in the plurality of runners together to form the runner assembly, and the runner assembly is permanently joined to the lower shell whereby each air outlet of the runner component is communicatively coupled to an air outlet in the plurality of air outlets of the bottom shell. The upper shell is configured such that it is removable attachable to the bottom shell to form a plenum chamber, wherein the runner assembly is entirely contained. In some embodiments, the upper and lower shells are attached with fasteners such as bolts threaded through shell fastener apertures.

In some embodiments, the runner assembly includes a runner corresponding to each cylinder in the plurality of cylinders. Each runner includes a first runner shell half having a first mating face, a second runner shell half having a second mating face, and the first and second runner shell halves are welded at the first and second mating faces. In some embodiments, the runners further include an attachment flange at a proximal end of the runner, a support member boss, and a support member aperture extending through the support member boss. In some embodiments, the runner assembly includes a support member extending through the support member aperture on each of the runners in the runner assembly, whereby the runners are secured to the support member. In some embodiments, the support members secures the runners together to form the runner assembly in a temporary fashion, such as by threaded attachment means, and in others the runner assembly is formed by permanent attachment of each runner to the support member.

In some embodiments, the lower shell includes an air outlet corresponding to each cylinder in the plurality of cylinders, a mating surface proximate to each air outlet whereon the attachment flange of a runner in the runner assembly is permanently attached, and a lower mating flange extending around a perimeter of the lower shell.

In some embodiments, the upper shell includes an upper mating flange extending around a perimeter of the upper shell and corresponding to the lower mating flange of the lower shell whereby the registration of the upper and lower mating flanges forms a plenum chamber containing the runner assembly therewithin.

It is an object of this invention to provide an air intake manifold of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
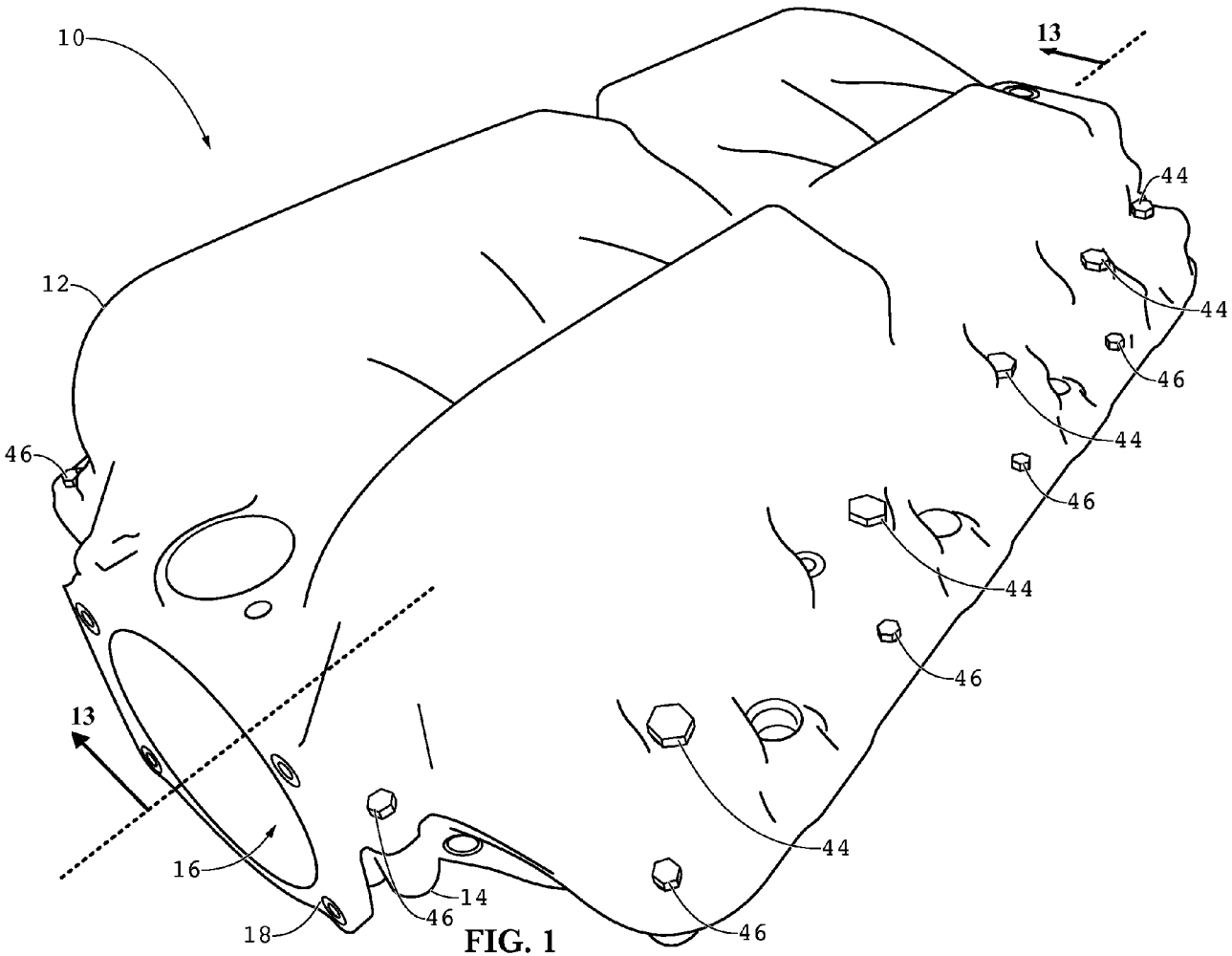
FIG. 1 is a perspective view of an exemplary embodiment of the invented intake manifold.

An exemplary embodiment of the invented intake manifold is shown in perspective view in FIG. 1. The manifold assembly 10 is generally configured as an enclosed plenum chamber defined by the coupling of two shells. In preferred embodiments, the plenum chamber is defined by an upper shell 12 and a lower shell 14 that are joined together with shell fasteners, such as bolts 46, or are more permanently joined, such as by welding. An air inlet 16 is formed between the upper 12 and lower 14 shells, or in one of the upper or lower shells, such as the upper shell 12 in the exemplary embodiment shown in FIG. 1. A throttle body mounting flange 18 may be provided around the exterior of the air inlet 16 on which a throttle body (not shown) may be mounted to control the airflow into the plenum chamber.

The upper 12 and lower 14 shells may be formed by casting or molding various types of materials, such as metals, plastics or polymers. Those skilled in the art will appreciate that various high strength materials with desirable weight and heat characteristics are suitable for use in manufacturing the shells of the manifold. Preferably, each of the upper 12 and lower 14 shells are nylonmold manufactured (cast nylon 6) as a single piece.

Figure 2:
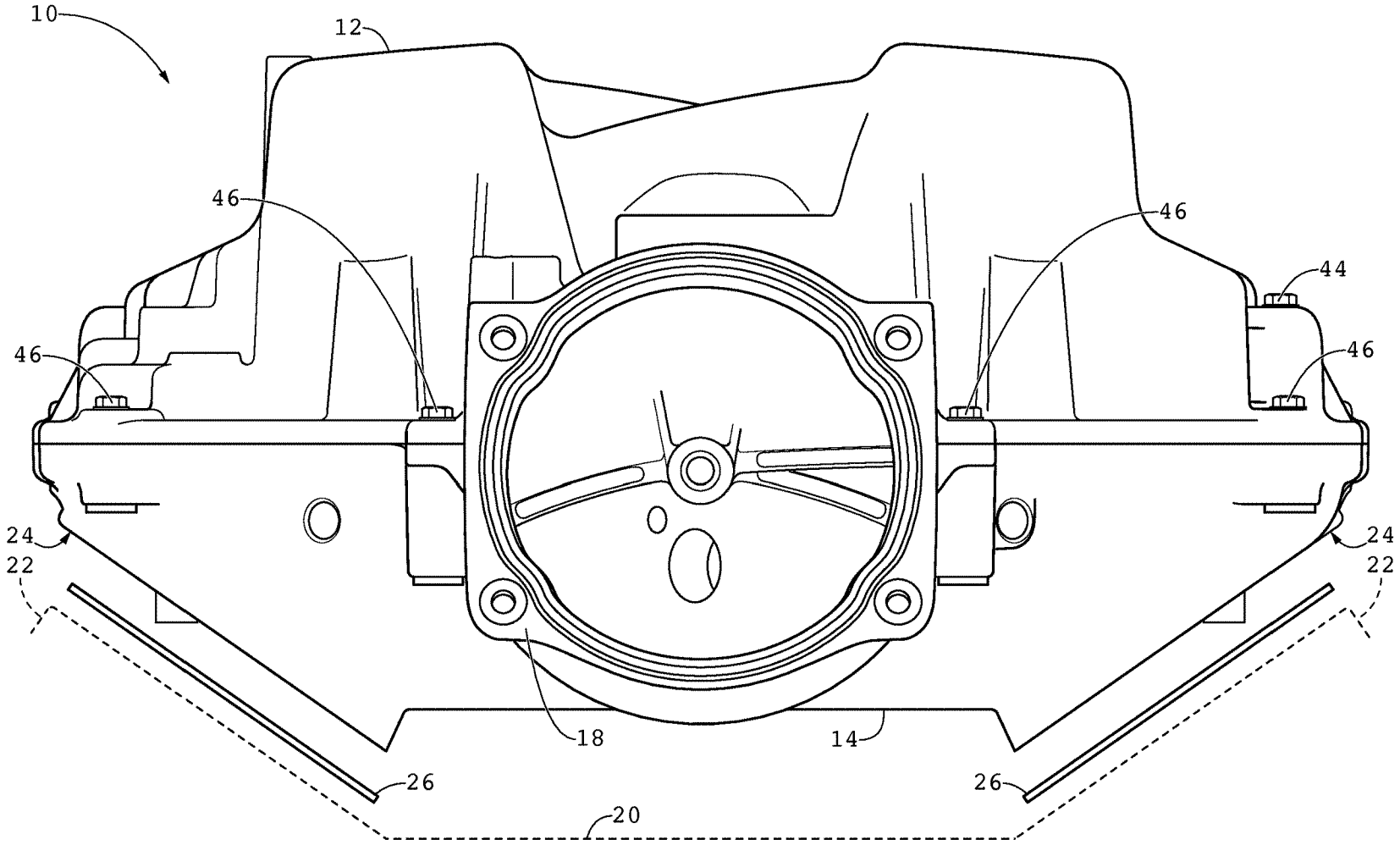
FIG. 2 is a front elevation view of thereof depicted in connection with a portion of an exemplary engine block.
Figure 3:
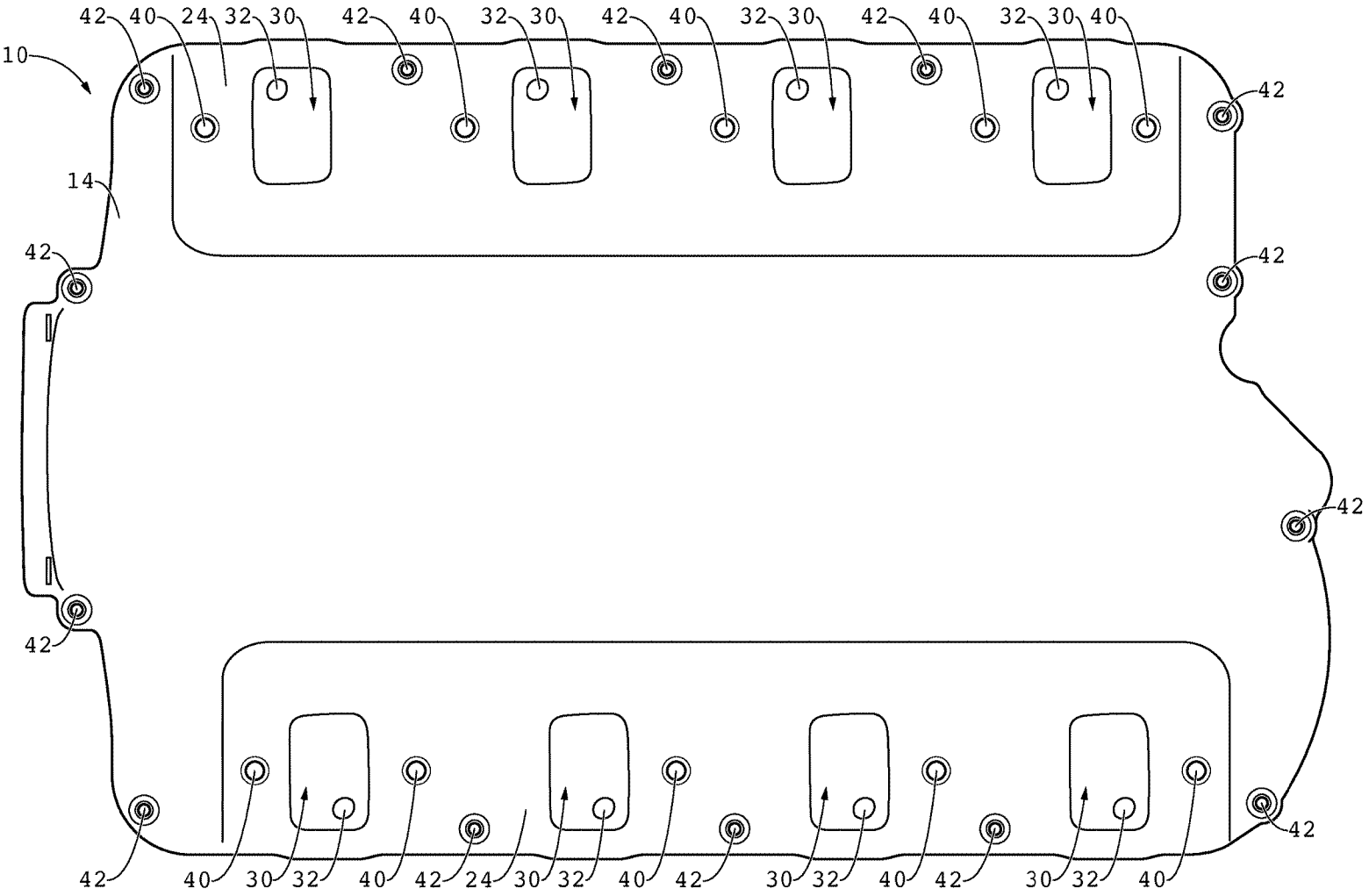
FIG. 3 is a bottom plan view of the intake manifold of FIG. 1.

Turning to FIG. 2, the exemplary intake manifold 10 is depicted in a front elevation view in connection with the cylinder head portions 22 of an exemplary engine block 20. The lower shell 14 includes one or more mating faces 24 adapted for mating with the cylinder head ports 22 of the engine block 20. Typically, one or more cylinder head gaskets 26 are used to seal the air passageway in the transition from the intake manifold 10 to the cylinder head 22. A bottom plan view of the intake manifold 10 is shown in FIG. 3, wherein the one or more mating faces 24 may be seen more readily. This exemplary embodiment of the intake manifold 10 is adapted for use with an eight cylinder V-type engine configuration, such as a small-block LS-series engine manufactured by General Motors. Therefore, it is depicted with two mating faces 24 each containing four air outlets 30 through which air may exit into the engine cylinder head ports from the manifold 10. FIG. 3 also depicts fuel injection apertures 32 wherein fuel injectors (not shown) are mounted, preferably near the air outlets 30 of the intake manifold 10.

Figure 4:
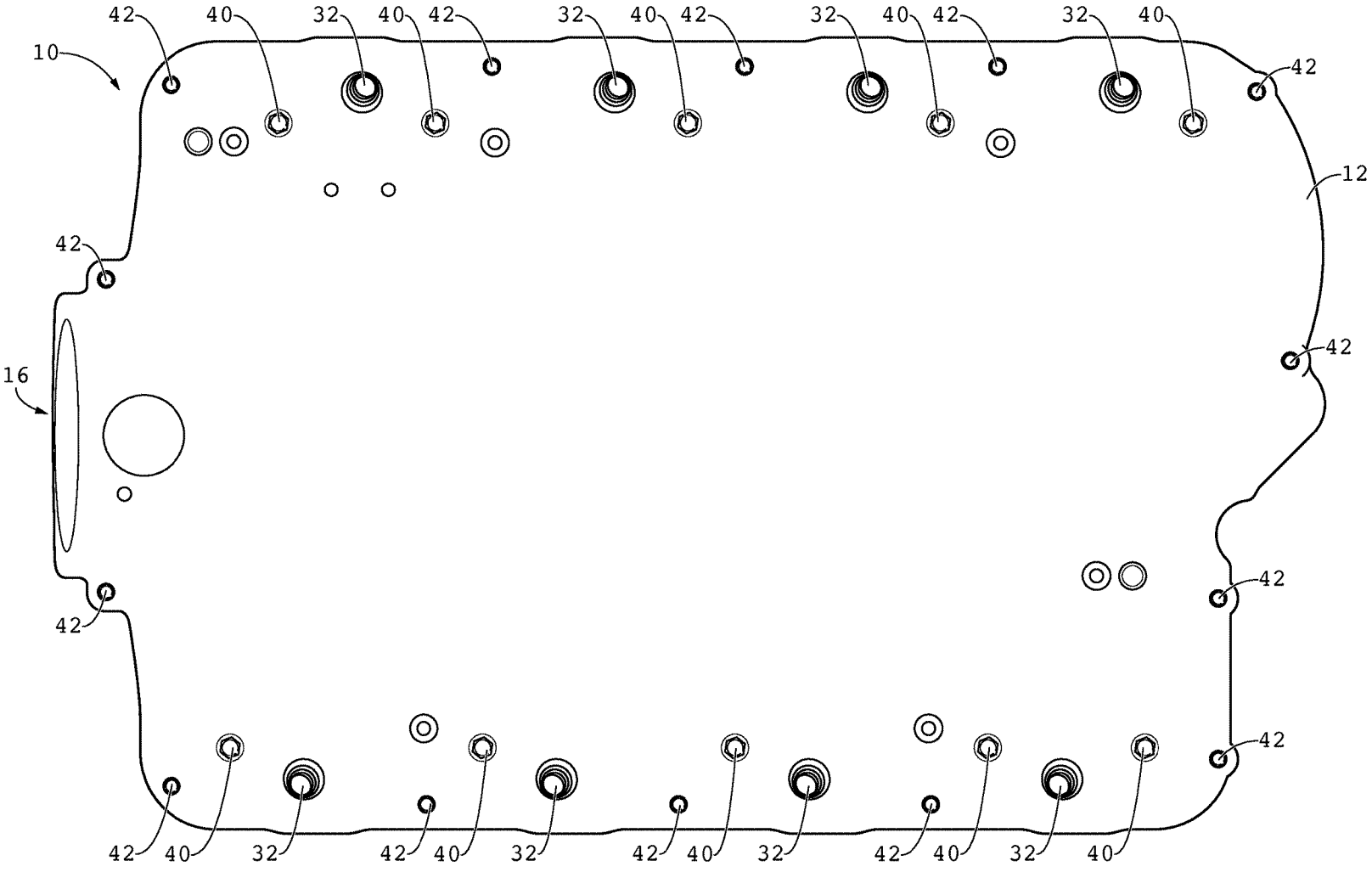
FIG. 4 is a top plan view of the intake manifold thereof.

A top plan view of the exemplary intake manifold 10 is shown in FIG. 4. Together, FIGS. 3 and 4 depict exemplary intake bolt apertures 40 and shell fastener apertures 42 that extend through both the upper 12 and lower 14 shells. The intake bolt apertures 40 each receive an intake bolt for securing the intake manifold 10 to the cylinder heads, and if fasteners are used, the shell fastener apertures 42 receive shell fasteners, such as bolts. Exemplary intake bolts 44 and shell fastener bolts 46 (e.g., hex flange head machine screws) are shown in connection with FIG. 1. Those skilled in the art will appreciate that more or less bolts may be used as desired, and that the number and position of the bolts may be configured differently for different engine applications. One advantage to the optional configuration shown is that the stock intake bolts may be reused if the intake manifold 10 is being installed as a replacement for an OEM manifold. The exemplary intake manifold 10 shown, for instance, is configured to bolt onto an LS7-series V-8 engine block using the stock (OEM) intake bolts.

Figure 5:
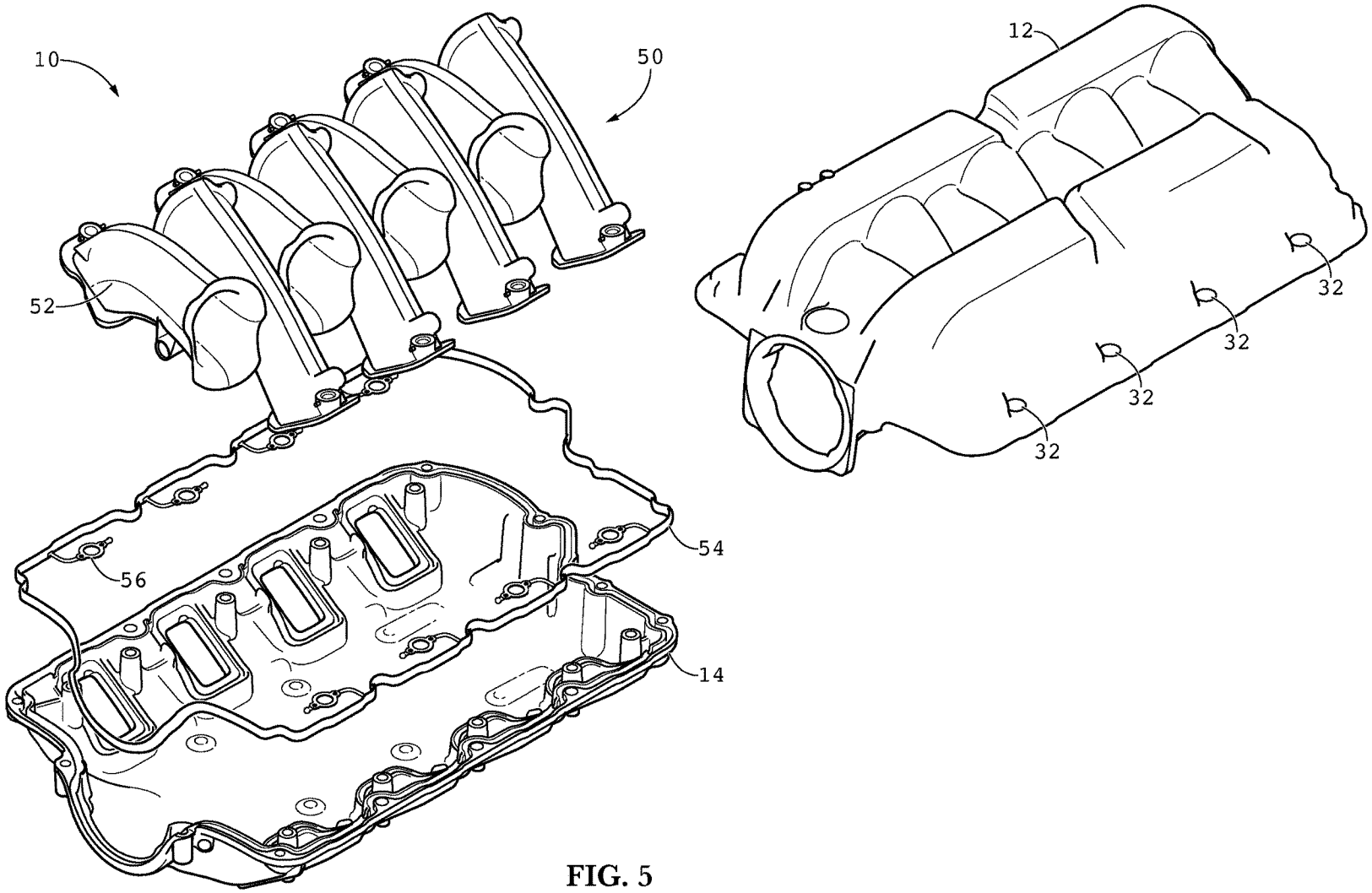
FIG. 5 is an exploded view thereof.

Turning to FIG. 5, further novel features of the present invention are described in connection with an exploded view of the exemplary intake manifold 10. The invented manifold includes at least an upper shell 12, a lower shell 14 and a runner assembly 50. The runner assembly 50 includes a plurality of runners—one runner for each air outlet or cylinder in the engine block—coupled together via a support member (not visible) received through a support member aperture of each runner. Each runner may be geometrically identical to the other runners in the runner assembly 50, thereby reducing manufacturing costs and time requirements. One such exemplary runner, runner 52, is further described in detail below in connection with FIGS. 6, 7A and 7B.

Figure 9:
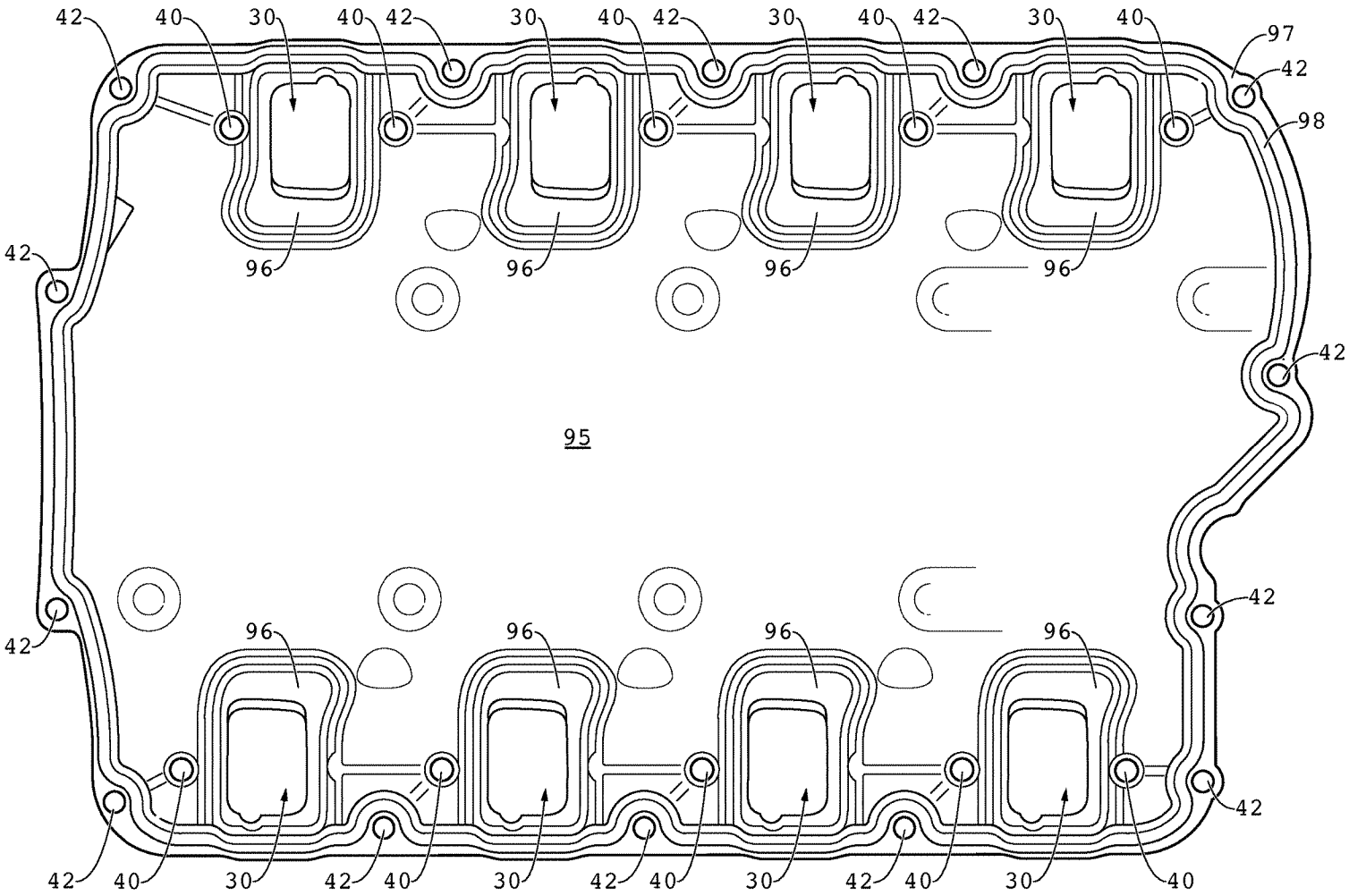
FIG. 9 is a top plan view of a lower shell component of the intake manifold of FIG. 1.
Figure 10:
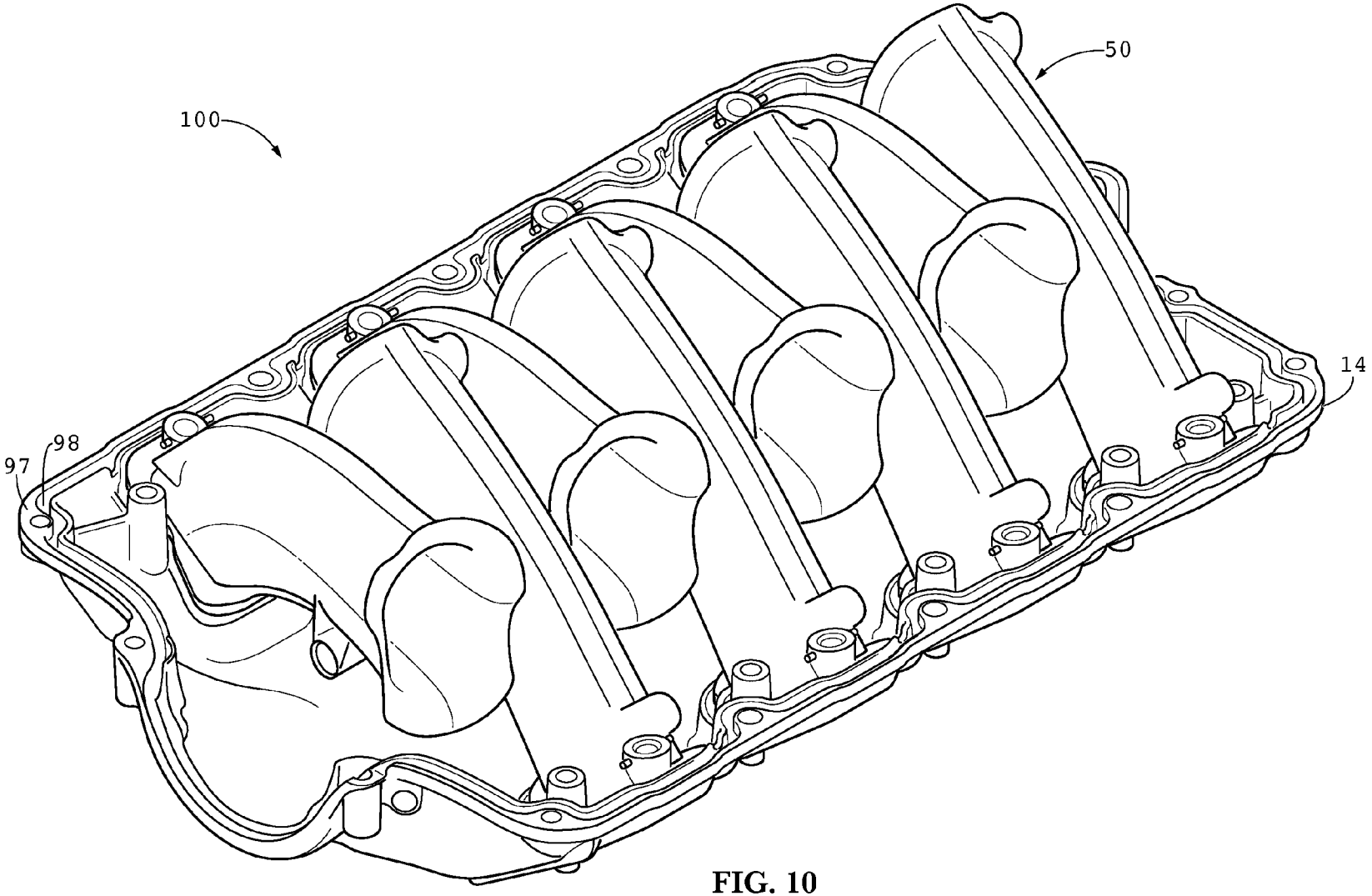
FIG. 10 is an upper perspective view of a base weldment of the intake manifold of FIG. 1.

For embodiments in which the shells are removably fastened to one another to form the plenum chamber of the manifold, the manifold includes a molded perimeter, or plenum assembly, seal 54 that fits within a perimeter groove (e.g., 98 in FIGS. 9-10). In some embodiments, the plenum assembly seal 54 further includes an injector seal tethered to the plenum assembly seal 54 corresponding to each runner in the runner assembly 50. For example, each injector seal 56 is tethered to the plenum assembly seal 54 and corresponds to a runner 52 in the runner assembly 50 shown in the exemplary embodiment. When the intake manifold 10 is assembled, the injector seals are seated between the injector boss (e.g., 76 in FIG. 6) of the runner, around the injectors (not shown) and the injector apertures 32 on the underside of the upper shell 12 (see FIG. 11 for further detail).

Figure 6:
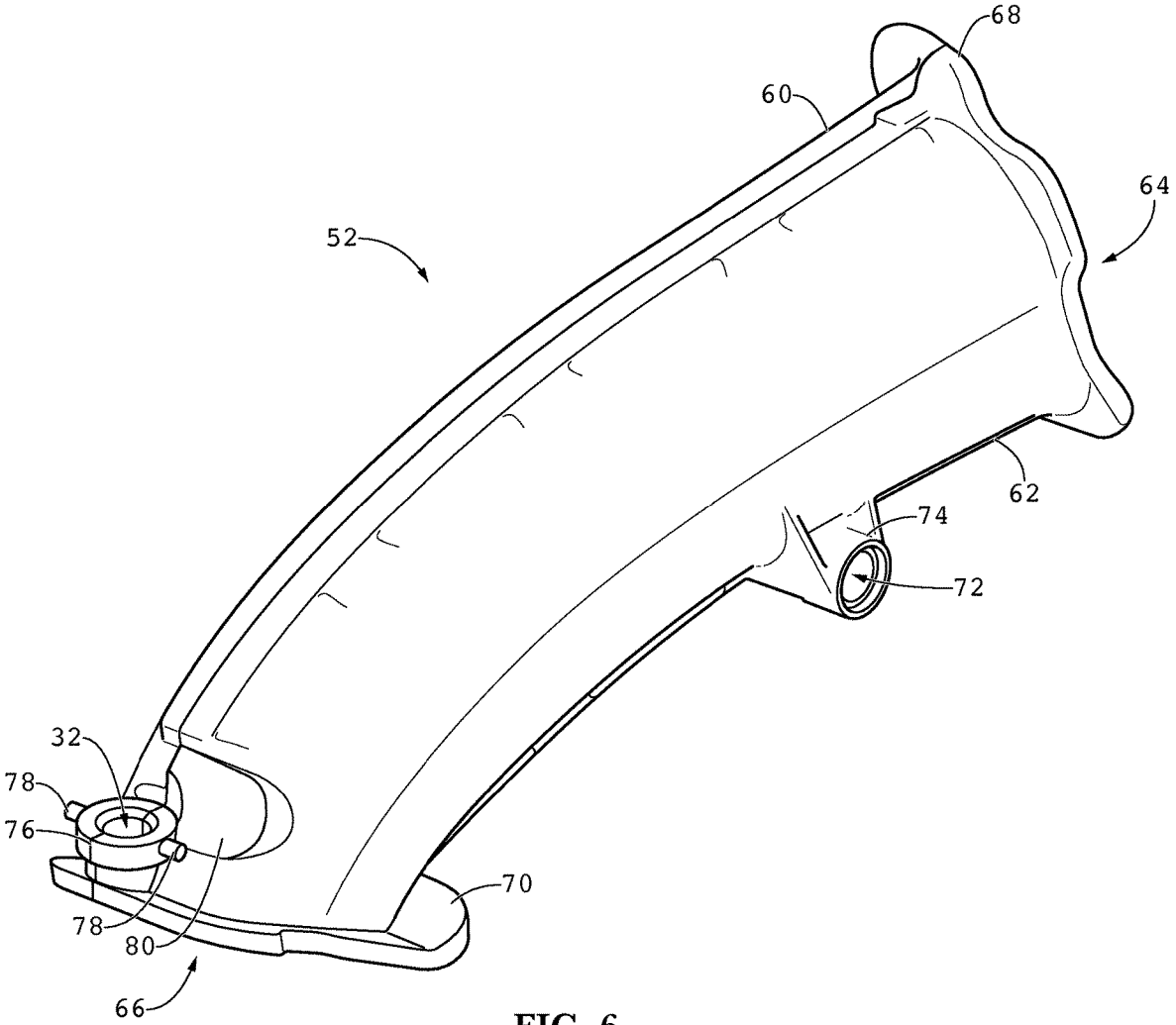
FIG. 6 is a perspective view of an exemplary runner portion of a runner assembly in the invented intake manifold.
Figure 7B:
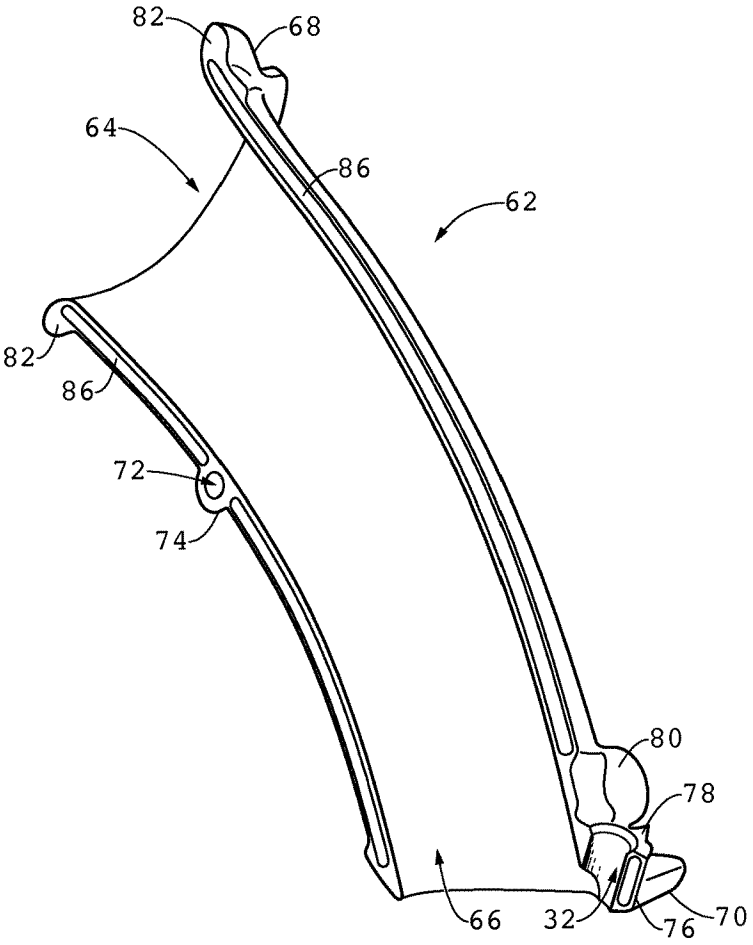
FIG. 7B is a perspective view of a second runner half of the exemplary runner portion of FIG. 6.
Figure 7A:
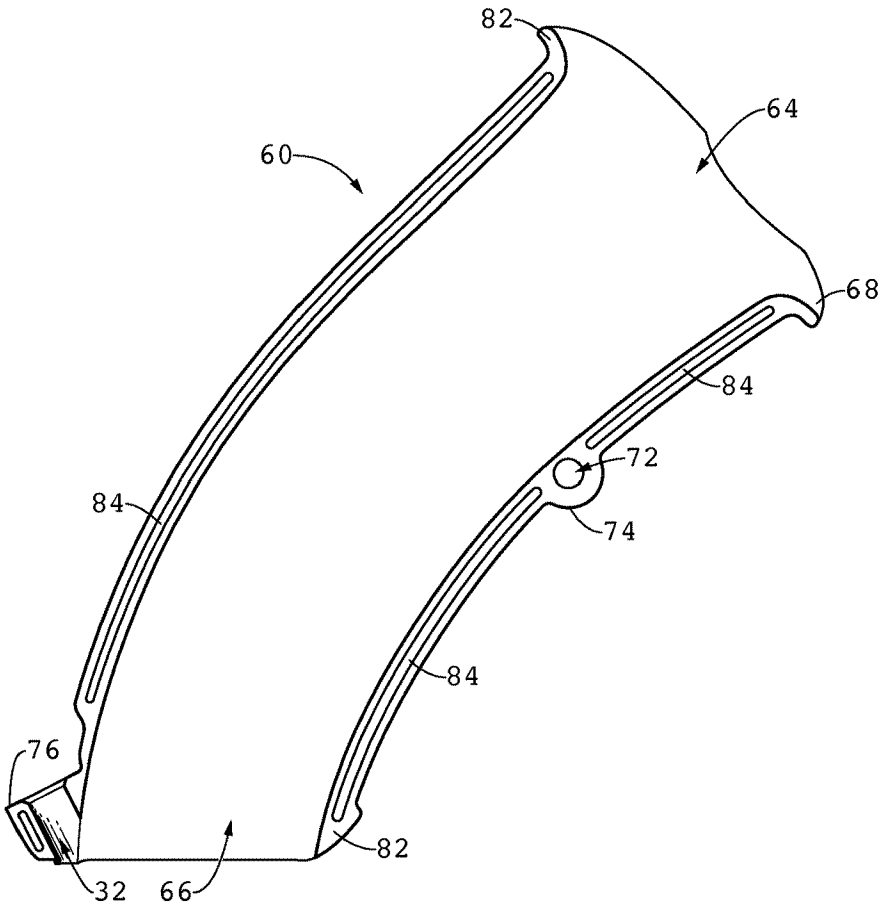
FIG. 7A is a side view of a first runner half of the exemplary runner portion of FIG. 6.

Turning now to FIGS. 6, 7A and 7B, an exemplary runner 52 of a runner assembly is shown in several views. FIG. 6 is a perspective view of the runner 52, which is preferably manufactured by injection molding two lengthwise halves of the runner shell 60 and 62, which are vibration welded together to form the runner 52 weldment. FIGS. 7A and 7B are separate views of the first 60 and second 62 runner shell halves prior to such assembly. The runner halves 60 and 62 and, consequently, the runner 52 itself, are formed to define an air inlet 64, an air outlet 66 and a generally tubular air passageway therebetween. They may also include an inlet bellmouth flange 68 to provide for smoother airflow characteristics, and an attachment flange 70 to provide additional material by which to better attach each of the runners in the assembled runner assembly to the lower shell.

Exemplary runners also include a support member aperture 72 through a support member boss 74 protruding from the underside of the runner. As explained in further detail in connection with FIG. 8 below, the runners are pre-assembled to form a runner assembly before installation within the manifold shell. The support member apertures for the runners should be positioned such that, when assembled, the apertures are aligned and configured to receive a support member therein.

Adjacent to the air outlet 66 of the runner 52 is an injector boss 76 through which the injector aperture 32 passes. The manifold is thus fittable with fuel injectors at each injector aperture 32, whereby fuel is imparted to the air flowing from the air inlet 64 to the air outlet 66 of the runner 52, resulting in an air/fuel mixture entering each of the cylinder heads. In preferred embodiments, the injector boss 76 further includes injector seal tangs 78 adapted for retaining an injector seal (e.g., 56 in FIG. 5) seated on the injector boss 76 and positioned between the boss 76 and the upper shell and fuel injectors. The cooperation of the injector seal tangs 78 and the unique injector seals 56 tethered to the plenum assembly seal 54 allows the injector to pierce two walls while maintaining seal for tuning pulses. The exemplary embodiment of the runner 52 shown also includes an optional nitrous boss 80 of thicker shell in order to facilitate the easy and safe installation of nitrous fogger nozzles (not shown) for instance by drilling access apertures therein.

FIGS. 7A and 7B also illustrate the complementary mating faces 82 that are provided on each of the first 60 and second 62 runner halves. In preferred embodiments, the runner weldment 52 is assembled by vibration welding the first 60 and second 62 runner halves together at the complementary mating faces 82. In some embodiments, the mating faces 82 of one runner half (e.g., first 60) are provided with one or more protrusions 84 configured to fit within corresponding grooves 86 provided on the mating faces 82 of the other (e.g., second 62) runner half, thereby providing a stronger runner weldment 52 upon assembly.

Figure 8:
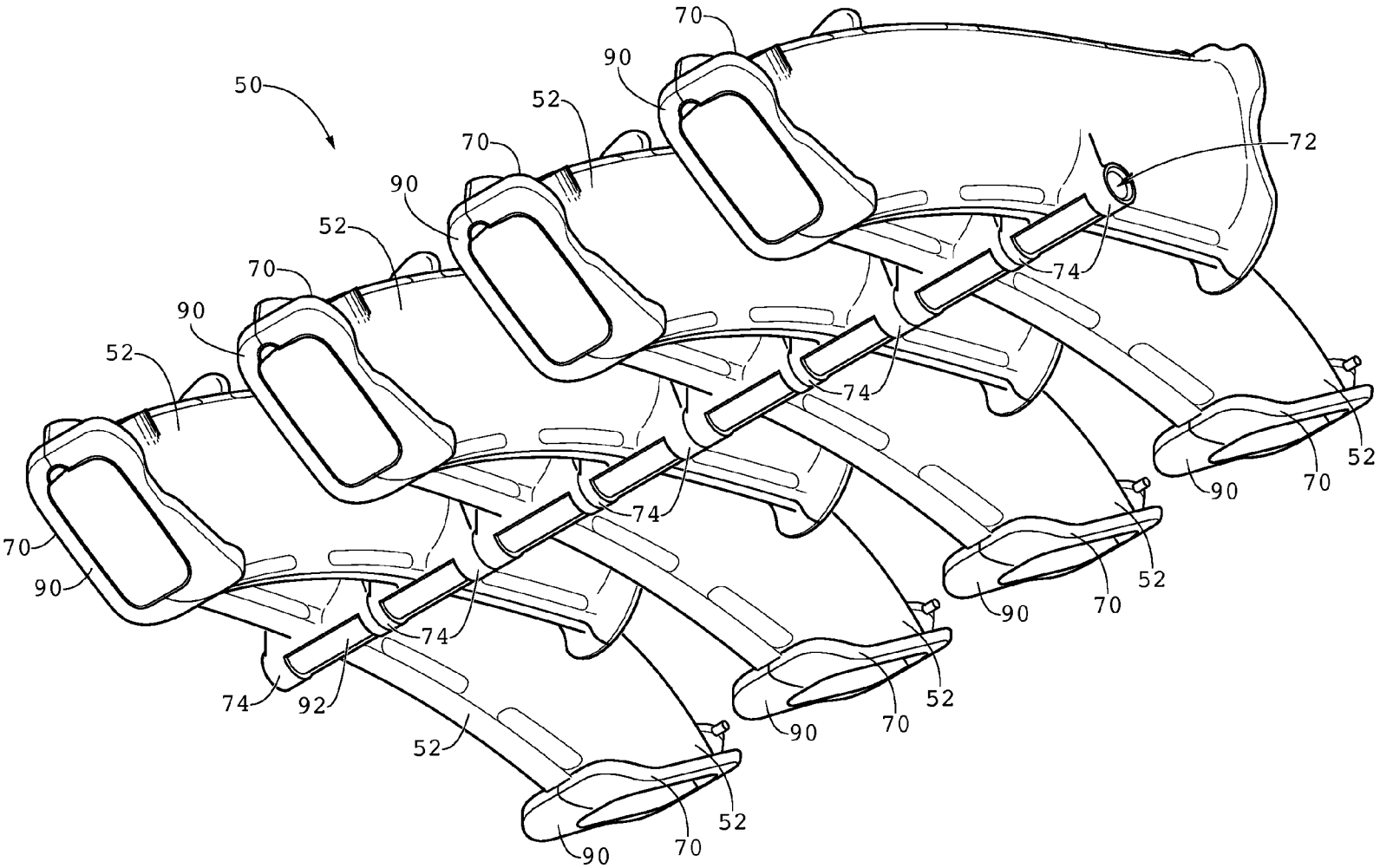
FIG. 8 is a lower perspective view of an exemplary runner assembly of the invented intake manifold.

Following the assembly of the runners, a runner assembly is constructed. A bottom perspective view of the runner assembly 50 of the exemplary intake manifold embodiment 10 is shown in FIG. 8. In this embodiment, all of the runners 52 are identical in geometry, and are assembled in an alternating, interlocking fashion such that the attachment flanges 70 are oriented at two opposing surfaces. The bottom surface 90 of each attachment flange 70 will mate with the interior surface of the lower shell (not shown) and are oriented to each correspond to one air outlet on the lower shell (i.e., air outlets 30 on lower shell 14 in FIG. 3). The runners 52 are assembled by aligning the support member boss 74 and corresponding support member aperture 72 on each runner 52, and inserting a support member 92 therein. Preferably, the runner assembly 50 is formed utilizing a single, threaded support member 92, but other comparable combinations may be desirable as well. The support member 92 fixes all of the runners 52 into position relative to one another, and does so in such a manner so as to, for instance, provide shared runner assembly support of the cantilever load experienced by the runner structures during assembly and while the intake manifold is in use. This feature has been found to be especially useful in high-power engine applications in better maintaining the integrity of the intake manifold and preventing damage caused by large acceleration- and deceleration-related forces, for example. Additionally, once the base weldment has been manufactured (see FIG. 10 and the accompanying description below), threaded embodiments of the support member may be further tightened to provide stabilizing support to the runner assembly.

A top plan view of the exemplary lower shell 14 of FIG. 5 is shown in FIG. 9. An exemplary number of air outlets 30 are again noted, whereby an air/fuel mixture is ultimately passed from the intake manifold to the cylinder heads. A portion of the interior surface 95 of the lower shell 14 adjacent to each of the air outlets 30 is provided as a mating surface 96. The mating surfaces 96 of the lower shell 14 correspond to the mating surfaces 90 of the runner assembly 50, and provide for complementary attachment between the assembly 52 and the lower shell 14. Note also that exemplary intake bolt 40 and shell fastener 42 apertures are indicated. The lower shell 14 is further provided with a perimeter mating flange or surface 97 and a plenum assembly groove 98 that cooperate with the plenum assembly seal (see 54 in FIG. 5) and method of attachment with the upper shell (not shown in this figure) to form an airtight seal around the shell joint at the perimeter of the intake manifold when assembled.

Turning now to FIG. 10, an exemplary base weldment 100 is depicted in perspective view. A base weldment 100 is formed generally when a lower shell 14 and a runner assembly 50 are permanently joined together. The permanent attachment of a runner assembly to a lower shell has been found to result in higher overall manifold strength and thus durability, and also provides ideal sealing characteristics that are particularly desired in high performance applications. For example, the bottom surfaces (see 90 in FIG. 8) of each of the runners 52 in the runner assembly 50 may be vibration welded, as in preferred embodiments, to mating surfaces (96 in FIG. 9) of the lower shell 14 adjacent to each of the air outlets 30. In other embodiments, the runner designs may be optionally molded into the lower shell itself. However, the method of first manufacturing a plurality of runners, attaching them together to form a runner assembly, and then welding the runner assembly to the lower shell is considered to be the preferred method of manufacture. End users of the invented intake manifold may modify the base weldment by, for instance, machining, grinding or other such manipulations. However, the base weldment is not intended for modular use wherein components of the base weldment are replaceable or interchangeable after manufacturing.

Figure 11:
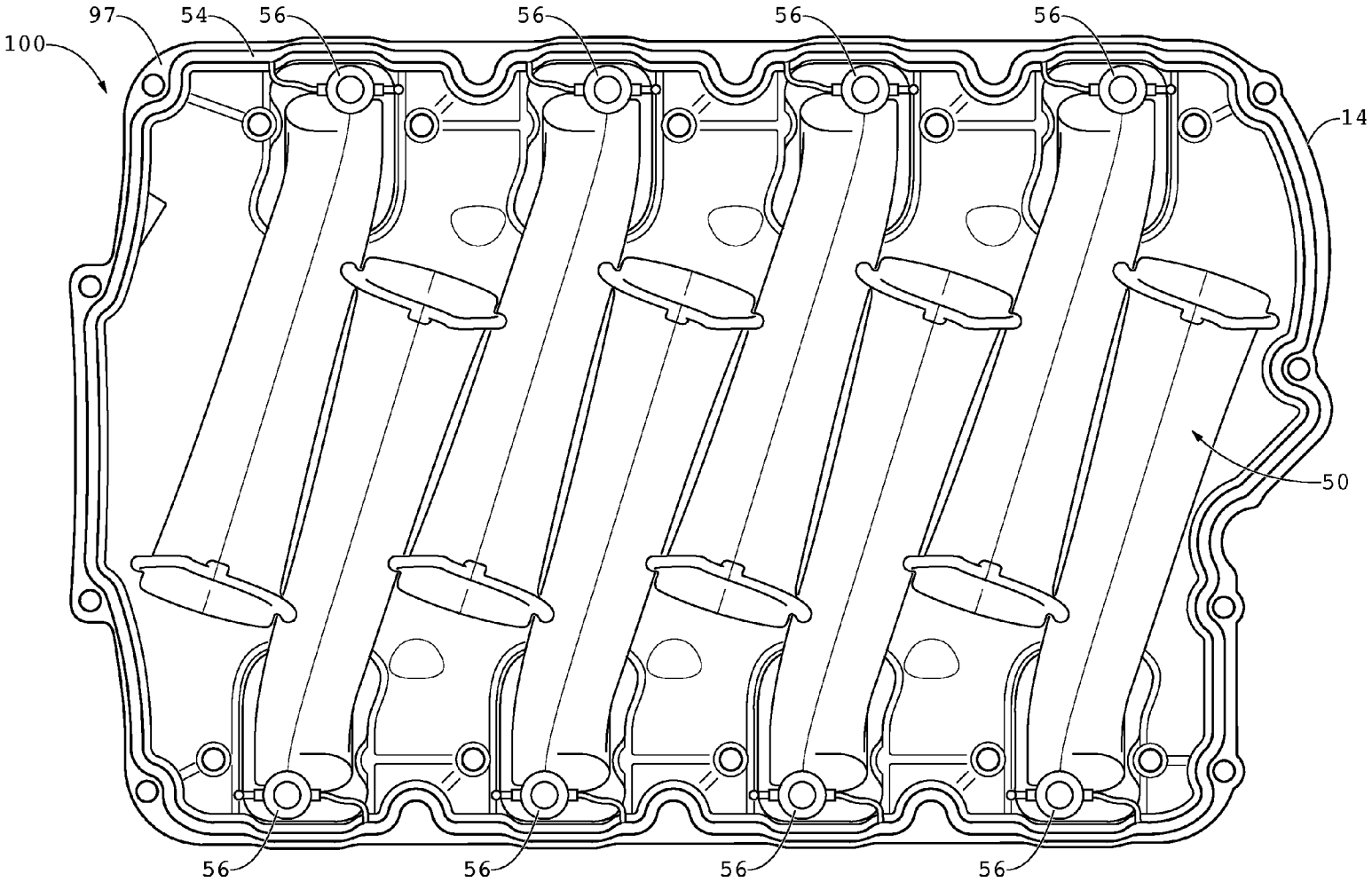
FIG. 11 is a top plan view of the base weldment thereof depicted with an exemplary plenum assembly seal.

FIG. 11 illustrates a top plan view of an exemplary base weldment 100 that includes the plenum assembly 54 and injector 56 seals positioned prior to attaching the upper shell (not shown) to the base weldment 100. This view also provides a top-down view of the runner assembly 50, and the optional identical construction of the components of the runner assembly 50 when installed. While a preferred embodiment of the runner assembly 50 is depicted here, those skilled in the art will appreciate that varying runner configurations are possible without departing from the scope of the invention herein. Furthermore, the preferred general configuration of the runners in the runner assembly 50 as shown are considered optimal due to the straighter profile over the length of the flow path. In the illustrated configuration particularly, the flow development at each runner is improved over the prior art with unshrouded straight runner profiles have more ideal bellmouth entrance characteristics. Additionally, the straightness of the runners is ideally such that, as in the exemplary embodiment depicted, the air outlet can be seen when viewed through the air inlet. This type of profile allows the user to port, machine, grind, etc. the base weldment to alter the air flow characteristics while still providing the strength and durability of welded connections.

Figure 12:
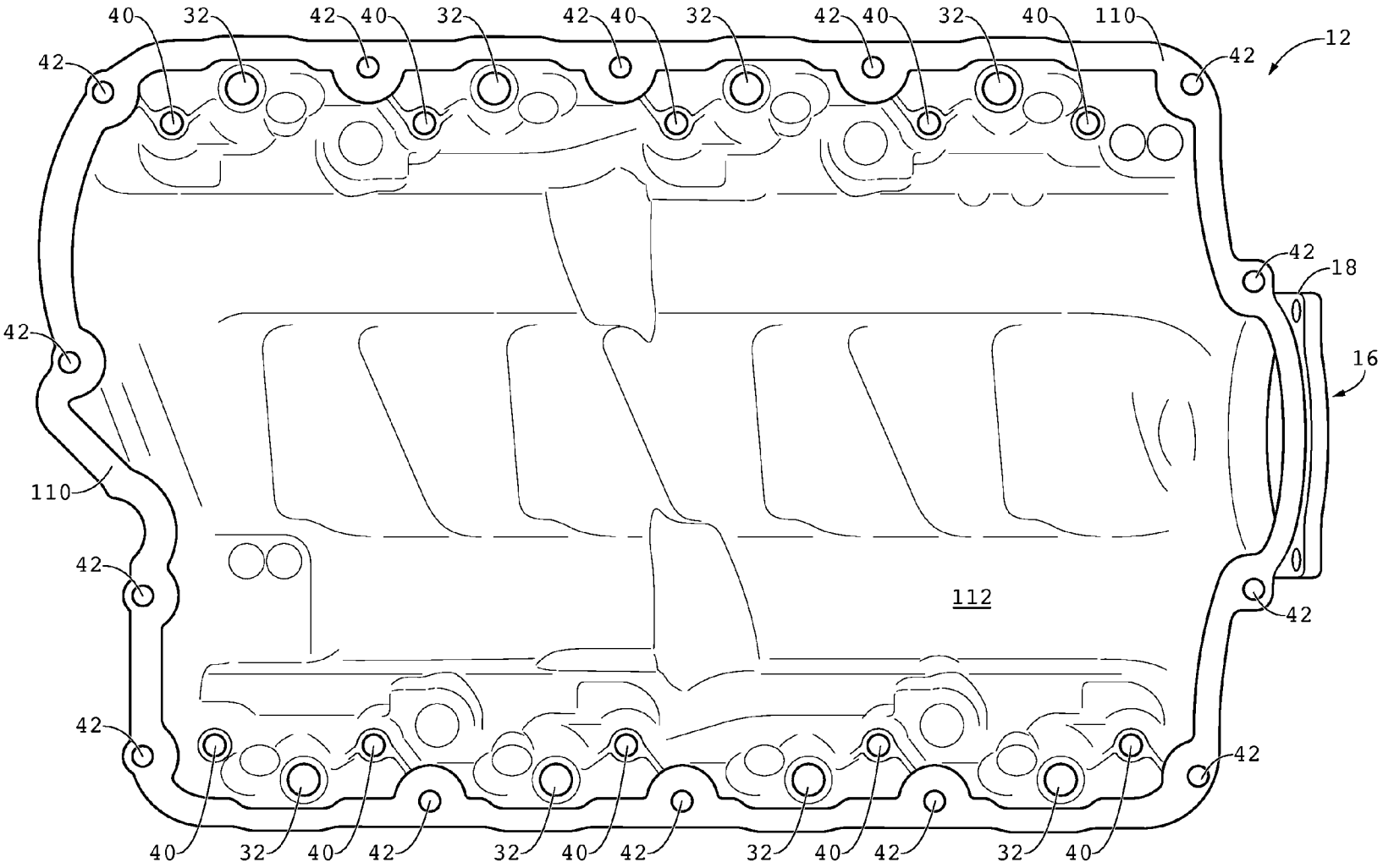
FIG. 12 is a bottom plan view of an upper shell component of the intake manifold of FIG. 1.

FIG. 12 is a bottom plan view of the exemplary upper shell 12 depicted in connection with FIG. 5. The upper shell 12 includes a mating flange or surface 110 that is complimentary to a lower shell, such as mating surface 97 shown in connection with FIGS. 9 and 10, and an interior surface generally 112. Also in this embodiment, the mating surface 110 is shown extending to encompass and define the air inlet 16 of the intake manifold, and includes the throttle body mounting flange 18 adjacent thereto. Note also that the locations of exemplary fuel injector 32, intake bolt 40 and shell fastener 42 apertures are indicated.

Figure 13:
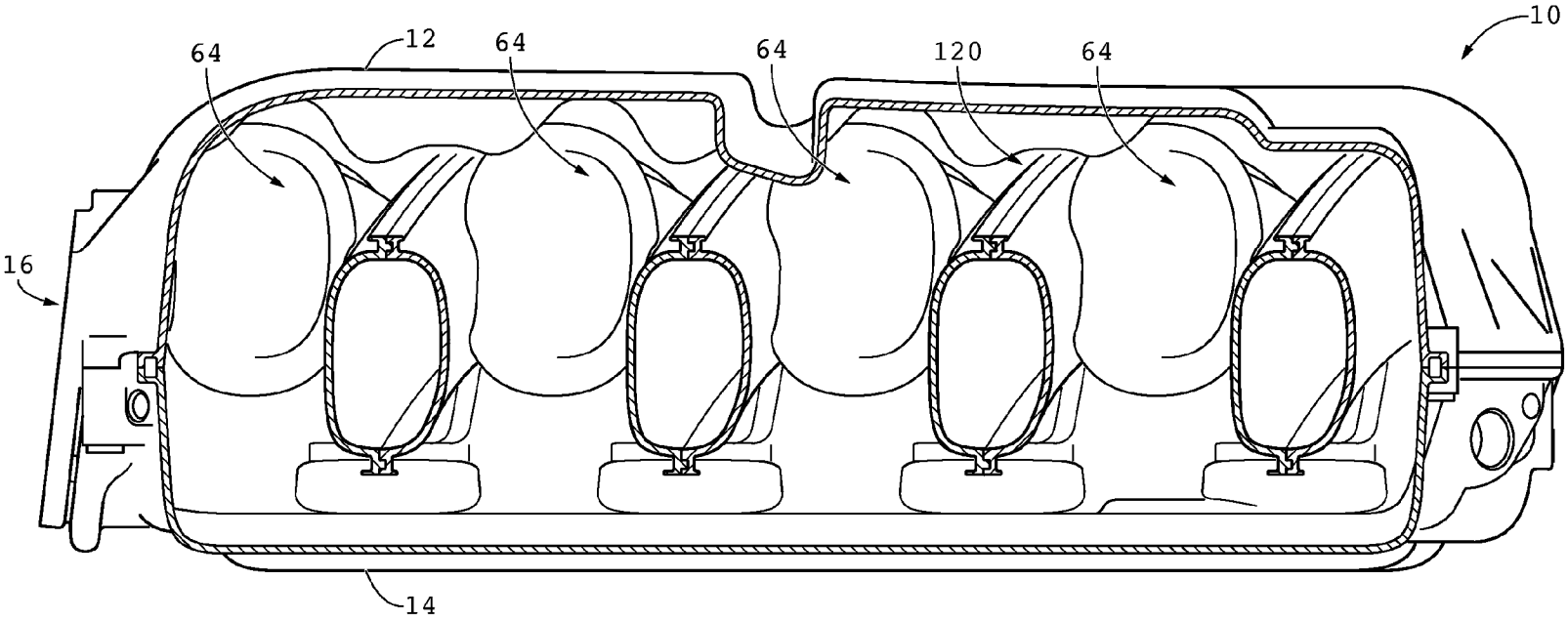
FIG. 13 is a section view of the intake manifold of FIG. 1.

A side elevation view of a cross section of the intake manifold 10 take through line 13-13 in FIG. 1 is illustrated in FIG. 13. Importantly, the design of the invented manifold results in desirable airflow characteristics in the plenum chamber 120 formed between the upper 12 and lower 14 shells. For instance, air flows into the air inlet 16 of the intake manifold 10 and is distributed throughout the plenum chamber 120 and further into the air inlets 64 in the runner assembly. An air intake manifold configured according to the teachings of the invention as described herein permits relatively equal air flow both above and below the air inlets 64, resulting in improved airflow characteristics and thus greater engine performance and efficiency.

The compact configuration of the robust runner assembly and base weldment components of the invented intake manifold described herein allows for the design of higher-performance intakes requiring high airflow volumes to be applied without exceeding vehicle manufacturer vertical clearance specifications. Furthermore, the shells may be formed in such a way so as to accommodate stock bolts, fasteners, and fuel rail assemblies, dramatically lowering the cost to the consumer while simultaneously providing increased performance previously found only in costly custom built intake manifolds. The runner assemblies are constructed having air inlets that are wider from wrapping over opposing runners, and thus are able to greatly increase the airflow volume through the intake manifold while remaining in the OEM intake size specifications. The base weldment and straight runner profiles further provide full access for modification without the complication of multiple pieces, such as separate runners, for instance. Also, the instant design provides the ability to configure the injectors to target the valves at the same angle as the production injectors, providing the invented aftermarket intake manifold the ability to maintain emissions performance, with higher than expected power performance and reduced flow restrictions at relatively low cost to the end user.

Referencing to FIGS. 5, 7A, 7B, and 8-9 an exemplary method of manufacturing the invented intake manifold 10 is disclosed. In one such exemplary embodiment, the lower shell 14, upper shell 12 and a plurality of first 60 and second 62 runner halves are injection molded. Each of the first 60 and second 62 runner halves are formed with a mating face 82. In a preferred embodiment, the first mating face carries a protrusion 84 and the second mating face carries a groove 86 thereon. A complete runner weldment 52 is formed corresponding to each cylinder in a plurality of cylinders in a particular internal combustion engine by vibration welding the mating face of the first runner shell half 60 to the mating face of the second runner shell half 62. The resulting runner weldment 52 exhibits an air inlet 64, air outlet 66, a support member aperture 72 formed in a support member boss 74, and an attachment flange 70 proximate the air outlet 66 having a bottom surface 90. Next, a runner assembly 50 is formed by securing a support member 92 within the support member aperture 72 of the plurality of runners 52. Next, the runner assembly 50 is permanently affixed to the lower shell 14 by vibration welding the bottom surface 90 of the attachment flange 70 of each runner 52 in the runner assembly 50 to one of the mating faces 96 in the plurality of mating faces of the lower shell 14.

In some embodiments, the lower shell 14 is molded to further include a plenum assembly groove 98 on the lower mating flange 97. In these embodiments, a plenum assembly seal 54 is injection molded of rubber-like or otherwise pliable material suitable for promoting an airtight seal upon fastening the upper 12 and lower 14 shells together. During installation, the seal 54 is placed in registration within and shaped to fit the plenum assembly groove 98 in the lower mating flange 97 of the lower shell 14.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An intake manifold comprising:

a base weldment comprising:

a lower shell having a plurality of air outlets; and a runner assembly comprising:

a plurality of individual runners each having an air inlet, an air outlet and a mating flange adjacent to the air outlet; and a single support member joining all of the runners in the plurality of runners together to form the runner assembly wherein each of the runners has at least one aperture to receive said single support member, wherein the runner assembly is permanently joined to the lower shell whereby each air outlet of the runners is communicatively coupled to an air outlet in the plurality of air outlets of the lower shell; and an upper shell removably attachable to the lower shell to form a plenum chamber.

2. The intake manifold of claim 1, wherein:

the lower shell further comprises a first perimeter mating flange and a plenum assembly groove thereon; and the upper shell further comprises a second perimeter mating flange.

3. The intake manifold of claim 2, further comprising a plenum assembly seal shaped to fit within the plenum assembly groove of the lower shell.

4. An intake manifold for an internal combustion engine having a plurality of cylinders, comprising:

a base weldment comprising:

a runner assembly comprising:

an individual runner corresponding to each cylinder in the plurality of cylinders, comprising:

a first runner shell half having a first mating face;

a second runner shell half having a second mating face, wherein the first and second runner shell halves are welded at the first and second mating faces;

an attachment flange at a proximal end of the runner;

a support member boss; and a support member aperture in the support member boss; and a single support member extending through the aligned support member aperture on each of the runners in the runner assembly, whereby the runners are secured to the support member; and a lower shell comprising:

an air outlet corresponding to each cylinder in the plurality of cylinders;

a mating surface proximate to each air outlet whereon the attachment flange of the runner in the runner assembly is permanently attached; and a lower mating flange extending around a perimeter of the lower shell; and an upper shell comprising an upper mating flange extending around a perimeter of the upper shell and corresponding to the lower mating flange of the lower shell whereby the registration of the upper and lower mating flanges forms a plenum chamber containing the runner assembly therewithin.

5. The intake manifold of claim 4, wherein the lower shell further comprises a plenum assembly groove on the lower mating flange.

6. The intake manifold of claim 5, further comprising a plenum assembly seal shaped to fit within the plenum assembly groove of the lower shell.

7. The intake manifold of claim 4, further comprising an injector seal tethered to the plenum assembly seal for each of the runner in the runner assembly.

8. The intake manifold of claim 7, wherein each of the runner further comprises two injector seals tang extending from opposing sides of the injector boss.

9. The intake manifold of claim 4, wherein the upper shell further comprises:

a throttle body mounting flange; and an air inlet formed within the throttle body mounting flange.

10. The intake manifold of claim 4, wherein the lower shell further comprises:

a throttle body mounting flange; and an air inlet formed within the throttle body mounting flange.

11. The intake manifold of claim 4, wherein:

the first runner half further comprises a protrusion on the first mating face; and the second runner half further comprises a groove on the second mating face complementary to the protrusion, wherein the protrusion is positioned within the groove.

12. The intake manifold of claim 4, wherein the support member is threaded into each of the support member apertures.

13. The intake manifold of claim 4, wherein each of the runner further comprises an injector boss proximate the proximal end of the runner.

14. A method of making an intake manifold for an internal combustion engine having a plurality of cylinders, comprising the steps of:

injection molding a first runner shell half corresponding to each cylinder in the plurality of cylinders, comprising a first mating face; and injection molding a second runner shell half corresponding to each cylinder in the plurality of cylinders, comprising a second mating face; and forming a runner by vibration welding the mating face of the first runner shell half to the mating face of the second runner shell half whereby a runner weldment is formed having an air inlet, an air outlet, a support member aperture formed in a support member boss, and an attachment flange proximate the air outlet having a bottom surface;

forming a runner assembly by securing a single support member within the support member aperture of each of a plurality of runners; and injection molding a lower shell comprising:

an air outlet corresponding to each cylinder in the plurality of cylinders;

a mating surface proximate to each air outlet whereon the attachment flange of a runner in the runner assembly is permanently attached; and a lower mating flange extending around a perimeter of the lower shell;

injection molding an upper shell comprising:

a throttle body mounting flange;

an air inlet formed within the throttle body mounting flange; and an upper mating flange extending around a perimeter of the upper shell and corresponding to the lower mating flange of the lower shell whereby the registration of the upper and lower mating flanges forms a plenum chamber containing the runner assembly therewithin;

permanently affixing the runner assembly to the lower shell by vibration welding the bottom surface of the attachment flange of each runner to one of the mating surfaces in the plurality of mating faces of the lower shell; and, removably connecting said upper shell and said lower shell.

15. The method of making an intake manifold of claim 14, wherein the lower shell further comprises a plenum assembly groove on the lower mating flange, further comprising the step of:

injection molding a plenum assembly seal shaped to fit within the plenum assembly groove.

16. The method of making an intake manifold of claim 14, wherein:

the first runner shell further comprises a protrusion on the first mating face;

the second runner shell further comprises a groove on the second mating face; and wherein the groove is placed in registration with the protrusion prior to forming the runner.

* * * * *